US005547709A

United States Patent [19]

Lukschandel et al.

[11] Patent Number: 5,547,709

[45] Date of Patent: Aug. 20, 1996

[54] SURFACE TREATMENT OF OPENING ROLLERS FOR OPEN END SPINNING

[75] Inventors: Jörg Lukschandel; Rudolf Patzon, both of Kempten; Jürgen Hassler, Durach, all of Germany

[73] Assignee: Elektroschmelzwerk Kempten GmbH, Munich, Germany

[21] Appl. No.: 282,163

[22] Filed: Jul. 28, 1994

Related U.S. Application Data

[63] Continuation of Ser. No. 104,999, Aug. 10, 1993, abandoned.

[30] Foreign Application Priority Data

Apr. 29, 1993 [DE] Germany ..... 43 14 161.7

[51] Int. Cl.[6] ..... B05D 3/00

[52] U.S. Cl. ..... 427/299; 427/319; 427/327; 427/374.1; 427/435; 427/387

[58] Field of Search ..... 420/299, 319, 420/327, 374.1, 387, 435

[56] References Cited

U.S. PATENT DOCUMENTS

| | | | |
|---|---|---|---|
| 2,731,676 | 1/1956 | Apthorp et al. | 19/114 |
| 2,937,413 | 5/1960 | Hollingsworth | 19/114 |
| 3,833,968 | 9/1974 | Arai et al. | 19/114 |
| 4,233,711 | 11/1980 | Hollingsworth | 19/114 |
| 4,435,953 | 3/1984 | Schmid et al. | 57/408 |
| 4,612,084 | 9/1986 | Schmolke | 156/639 |
| 4,882,812 | 11/1989 | Fetzer et al. | 19/112 |
| 4,991,501 | 2/1991 | Yokoyama et al. | 101/148 |
| 5,006,367 | 4/1991 | Lancsek | 427/129 |

OTHER PUBLICATIONS

Textile Month, "Putting Diamonds To Work in Textile Machinery", May 1981, pp. 61, 67.

Metalloberfläche 38, 1984, No. 4, pp. 139–142, J. Lukschandel:"Funktions–und Verschleissschutzschichten".

Textile Month, May 1981, "Putting diamonds to work in textile machinery".

*Primary Examiner*—Shrive Beck
*Assistant Examiner*—Brian K. Talbot
*Attorney, Agent, or Firm*—Burgess, Ryan and Wayne

[57] ABSTRACT

A process for surface treatment and wear resistant coating of opening rollers for open end spinning of the type having a basic metallic body and a raw wire clothing, includes the steps of introducing the opening roller into a sealing bath in such a way that this sealing bath fills even the smallest voids between the raw wire and the basic body of the roller, rinsing off the opening roller clean on the outside, heat treating the opening roller, and subjecting the opening roller thus pretreated to deburring and antiwear coating in a conventional manner.

11 Claims, 1 Drawing Sheet

SURFACE TREATMENT OF OPENING ROLLERS FOR OPEN END SPINNING

This application is a continuation of application Ser. No. 08/104,999, filed Aug. 10, 1993, abandoned.

BACKGROUND OF THE INVENTION

The invention relates to a process for surface treatment of opening rollers for open end spinning.

Open end spinning is at present the most economical way of producing yarn from short fiber. The most essential components of an open end spinning unit are the opening roller and the spinning rotor. The opening roller separates the feed sliver into its individual fibers, just a few micrometers thick, removes impurities and feeds the fibers through a feed tube into the spinning rotor, where they are reassembled to form a yarn. The working of the opening roller has a crucial bearing on the stability of the spinning process and on the quality of the yarn product.

A common form of opening roller is a ring-shaped structure made of aluminum or steel, whose circumferential surface is equipped with a spiral-shaped slot fitted with a finely toothed steel tape - the wire clothing- fixed in place by caulking. FIG. 1 shows a partly broken-away opening roller ring comprising the aluminum body 1 and the clothing wire spiral 2.

Examples of opening rollers and toothed tapes or wire may be found inter alia in U.S. Pat. Nos. 2,937,413, 4,233,711, 2,731,676, 4,435,953 and 3,833,968. The toothed tape clothing are usually produced by rolling an initially round wire into the characteristic cross-sectional shape and then stamping out the teeth from the flat part of this profile tape. Such a clothing wire is shown in cross section in FIG. 2*a* and in a partial side view of FIG. 2*b*. Sometimes the tooth flanks are subjected to a mechanical after-treatment by grinding. This is described for example in U.S. Pat. No. 4,233,711.

The clothing wire is at this stage still in the raw state. The edges of the teeth of the raw wire are sharp and in part very rough. Opening rollers equipped with a clothing wire in this state have completely unacceptable spinning characteristics; the fine fibers are destroyed or become lodged in the rough areas of the teeth only to become detached from time to time and create thick places in the yarn product.

It is therefore common practice to subject clothing wires for opening rollers, prior to mounting on the roller body, to an electrolytic or chemical treatment. This treatment serves to round the sharp edges and generally improves the surface quality. To this end, the raw wire is successively degreased, descaled, pickled and deburred in various electrolytic and/or chemical baths. Thorough rinsing is necessary between the actual operations, and this results in the entire treatment being laborious and costly.

The surface state of the teeth resulting from this treatment is known as needle finish. It is considered absolutely mandatory for satisfactory working of an opening roller equipped with wire clothing. A reference to this needle finish may be found for example in U.S. Pat. No. 5,006,367, column 2, lines 9–10.

It is also common practice to protect the teeth of opening rollers from wear and hence to prolong the useful life of opening rollers by specific surface-technological measures. A particularly effective measure is the application to the needle finished, wire clothed opening roller of a dispersion coat consisting of autocatalytically deposited nickel with embedded diamond particles. This is described inter alia in Metalloberfläche 1984, No. 4, page 139, or Textile Month, May 1981. Opening rollers equipped with such a nickel-diamond coating have service lives which exceed those of uncoated ones by a factor of from five to ten.

Like the above-described deburring and rounding treatment of raw wire, a nickel-diamond coating requires multistage treatment in dip baths, so that it is desirable to combine the two processes in an economical manner. Such a combination would have appreciable advantages:

a) Manufacturing opening rollers using the significantly less costly, non-deburred raw wire represents an appreciable cost saving. The actual deburring is merely an additional pretreatment step prior to the nickel-diamond coating which is carried out in any case and therefore represents only an insignificant additional cost.

b) Owing to the geometrically exact position of the wire on the roller body, the deburring process is more defined and more reproducible than in the hitherto customary bundle or in a continuous process, reducing the proportion of rejects due to surface flaws.

Prior endeavors in the art have indeed confirmed the basic feasibility of such a combined process. However, it has hitherto not been possible to mass produce a reliable product. This is because of a peculiarity of the manufacture of wire clothed opening rollers which leads to damage following a very long latent period:

To be able to pull the clothing wire into the spiral-shaped slot of the roller body, the slot has to be somewhat wider than the wire foot. In addition, variations in the rolling of the wire and in the wear of the tools for cutting the slots are responsible for size differences which lead to voids of variable size between the wire and the slot wall of the roller body. It has been found to be technically impossible in a mass production process to eliminate or seal off these voids using the caulking operation carried out for fixing the wire on the body of the roller.

If a wire clothed opening roller is dipped into a deburring bath, the aggressive fluid of the bath will also penetrate into the above mentioned voids and attack the metal surfaces. Initially this is no problem and is in general hidden by the subsequently applied nickel-diamond coating. Since, to achieve maximum wear resistance, the coating is followed by a heat treatment at from 250° to 350° C., the fluid remaining in the voids will also evaporate completely, leaving behind dry salts. The opening rollers subsequently deburred and coated in a single operation do indeed appear to be free of flaws directly following the surface treatment.

However, if such rollers come into contact with higher atmospheric humidity over a period, the dry salts will regain their chemical activity and restart the interrupted corrosion processes. In spinning mills, where opening rollers are used in accordance with their intended use, the humidity is in fact artificially raised to avoid electrostatic charge buildups so that sooner or later, a large proportion of the rollers will fall victim to corrosion on an unacceptable scale.

Acceptable to an end user of opening rollers means a maximum proportion of <10% of opening rollers with individual rust spots.

It is known of aluminum alloys that they are attacked not only by alkaline but also by acidic media and that, once started, corrosion processes are in practice impossible to stop. Opening rollers based on bodies made from such alloys will eventually show corrosion efflorescence which causes even firmly adhering and stable surface layers to spall.

Roller bodies made of iron materials are altogether prone to rusting, so that an opening roller made entirely of steel will usually require an all-over corrosion protection. The subsequent formation of rust by the mechanism described above leads to similar damage as produced by the corrosion of aluminum and is therefore similarly unacceptable.

There have been attempts to fill out the unavoidable void between the body and the clothing by introducing a plastic material in a specific manner at the same time as the wire. Depending on the composition of the plastic material, this in turn led to unacceptable problems in the chemical treatment for producing the needle finish or in the final hardening of the nickel-diamond dispersion layer.

It has accordingly been hitherto impossible to carry out the deburring of clothing wires for opening rollers after the wires have been mounted on the roller bodies in such a way as to reduce, to a level acceptable to the consumer, the later occurrence of corrosion phenomena in the gap between the body and the wire and to apply an antiwear coating, for example a nickel-diamond dispersion layer to these opening rollers directly following deburring in a single multi-stage treatment process.

SUMMARY OF THE INVENTION

It is the object of the invention to provide a process for surface treatment and wear resistant coating of opening rollers for open end spinning comprising a basic metallic body and a raw wire clothing whereby the deburring of the clothing wire and the coating of the metallic opening rollers, plus wire clothing, is possible without the above-described disadvantages of this combination.

This object is achieved according to the invention by a process which comprises a) introducing the opening roller into a sealing bath in such a way that this sealing bath fills even the smallest voids between the raw wire and the basic body of the roller, b) rinsing off the opening roller clean on the outside, c) heat treating the opening roller, and d) subjecting the opening roller thus pretreated to deburring and antiwear coating in a conventional manner.

DETAILED DESCRIPTION OF THE PREFERRED EMBODIMENTS

Figure 1:
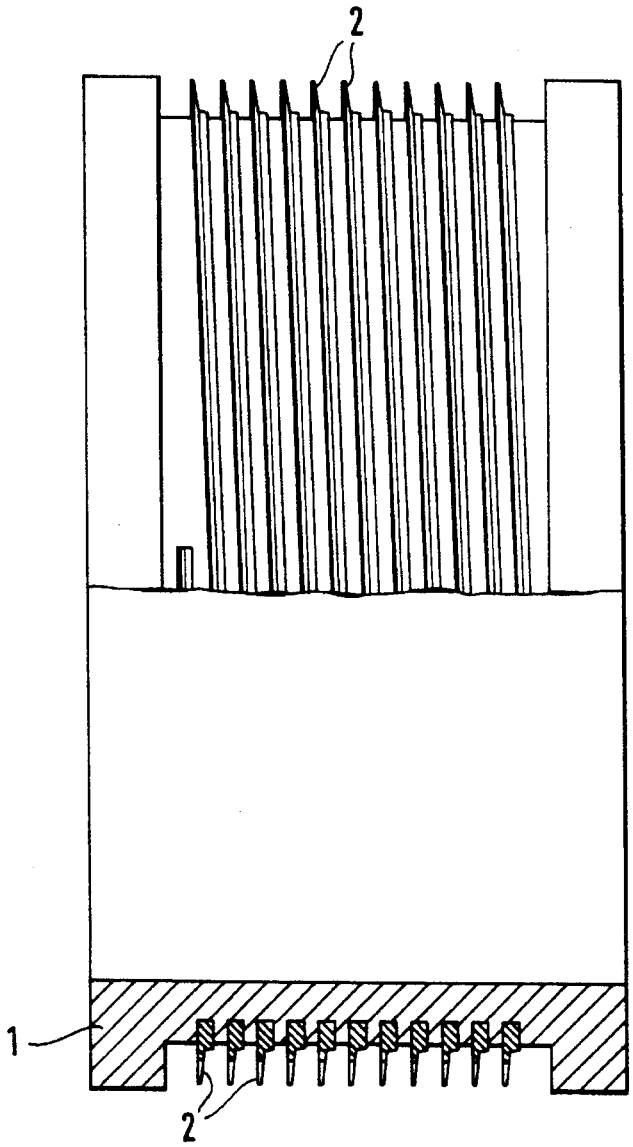
FIG. 1 is a plan, partially broken away view of an opening roller.
Figure 2B:
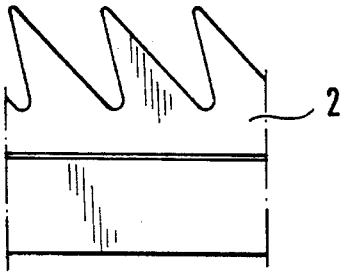
FIG. 2*b* is a plan view showing the clothing wire spiral.
Figure 2A:
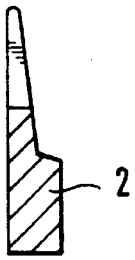
FIG. 2*a* is a cross-sectional view, of clothing wire of the opening roller of FIG. 1.

To carry out the sealing treatment of the invention, opening rollers with wire clothing are first heated to a sufficiently high temperature to remove any moisture residues from all the voids. In the hot state, they are then dipped into a liquid in which the sealing/passivating substances are in solution or fine dispersion and are allowed to cool down in this liquid. In the course of cooling, the hot air remaining in the voids strongly contracts; the result is a vacuum which causes the surrounding liquid to penetrate even into the finest voids. If necessary, this penetration of liquid can be improved still further by, for example, closing the dip container and additionally pressurizing with compressed air or pumped-in liquid.

The sealing and/or passivation has been chosen in such a way that it interferes neither with the deburring of the clothing wire, nor with the subsequent antiwear coating, nor with the final heat treatment.

The opening rollers removed from the impregnating bath are rinsed off clean at the surface. Surprisingly, the sealing solution in the voids between the raw wire and the slot wall of the roller body is not replaced by the rinse water.

In a two-stage heat treatment step, first the solvent of the sealing liquid in the voids between the raw wire and the slot wall is slowly evaporated so that the substances present in the sealing liquid become deposited on the walls of the voids in the form of a film. If necessary, depending on the sealing solution used, a further temperature increase is employed to modify the crystal structure and the surface constitution of the previously formed film in such a way that it will no longer be attacked, let alone dissolved, by the acids, alkalis or rinse liquids which will act on it in the course of the later deburring and coating.

Suitable sealing agents include not only waterborne solutions of substances which on drying or following subsequent heat treatment, form unbroken, insoluble films but also solutions thereof based on organic solvents. However, the latter have the disadvantage that they are either flammable or harmful and require special handling precautions. An example of a sealing agent which is technically effective but has the above-mentioned disadvantages is a solution of acrylic polymer in ethyl alcohol or acetone.

According to the invention, the preference is therefore for aqueous solutions of substances which, on drying or following a subsequent heat treatment, form unbroken, insoluble films on the walls of the voids.

Examples of such substances are silicates or phosphates such as silica sol, silicophosphate or monoaluminum phosphate or mixtures thereof. They can be used in aqueous solutions up to their solubility limits.

Opening rollers pretreated in this way are then subjected in a conventional manner to successive degreasing, descaling, pickling and deburring in various electrolytic and/or chemical baths and antiwear coating. Of particular suitability for use as antiwear coatings are the nickel-diamond coatings known from the prior art.

The examples which follow illustrate the invention. All the examples were carried out with opening rollers from the same manufacturer. The construction of the parts used corresponded to FIG. 1.

EXAMPLE 1

Surface treatment of opening rollers having a slot-fitted raw wire clothing with a silica sol solution followed by deburring and coating:

100 opening rollers comprising untreated clothing rings already fitted by the manufacturer with stamped and hardened raw wire without needle finish were mounted loosely on a support frame and heated thereon in a through-circulation oven to 200° C. in order that any residual moisture might be expelled from the remaining gap between the body and the clothing wire. The support frame bearing the hot parts was then rapidly dipped into a room temperature (about 23° C.) solution of 15% of silica sol ($SiO_2$) in water and allowed to cool down therein to room temperature.

After cooling, the batch was taken from the solution and dipped in succession into two tanks filled with tap water at room temperature. After the water had dripped off, the entire batch was dried for 12 hours in a through-circulation oven preheated to 50° C., gradually expelling the water from the silica sol solution. Then the oven temperature was raised to 250° C. and maintained at that level for 2 hours in order that the $SiO_2$ layer remaining behind in the voids between the body and the wire clothing might be hardened.

After cooling, the opening rollers thus treated were deburred in a single multi-stage treatment process and provided with a nickel-diamond coating, both the process and the coating being carried out in a conventional manner.

To this end, the opening rollers were mounted on the support units necessary for the nickel-diamond coating and dipped into the customary, necessary treatment baths by means of a partly automatic transport means. The normal process sequence for nickel-diamond coating comprises a hot degrease, an acidic pickle to remove oxide film or scale from steel surfaces, another brief pickle to activate the steel surface and a treatment to activate the aluminum surface for chemical nickelization.

Following the pickling treatment to remove scale from the steel surface, the opening rollers were additionally dipped into a commercial chemical deburring bath in order that the sharp edges of the teeth of the clothing wire might be rounded and the plateau-like tips be transformed into a needle shape having a defined radius of curvature. Following this deburring treatment, the above-described process customary for nickel-diamond coating was continued with the activating steps and concluded with the application of the diamond dispersion coat.

The coating was followed by the usual heat treatment at 350° C. over 2 hours for obtaining the maximum wear resistance of such coats. Finally, the coated and heat treated parts were freed of adhering diamond particles and other impurities in a conventional manner by blasting with fine glass balls.

To test the corrosion tendency, the parts were exposed for 100 hours in a conditioning chamber to conditions frequently encountered in spinning mills; a temperature of 50° C. and relative humidity of 80%. To speed up visible rusting in areas where the moist air can penetrate into the gap between the body and the steel wire, the atmosphere in the conditioning chamber was doped with 0.01 g of hydrochloric acid per liter of air.

After this weathering test had ended, the parts were removed from the conditioning chamber, dried at 150° C. and subjected to visual examination under a stereoscopic microscope at 30-fold magnification; 10 parts showed rust efflorescence.

EXAMPLE 2

Surface treatment of opening rollers having a slot-fitted raw wire clothing with an aqueous silicophosphate solution followed by debutring and coating:

100 opening rollers as in Example 1 were subjected to the same treatment as described in Example 1. In contradistinction to Example 1, the impregnant used for the voids was a 20% strength solution of silicophosphate (FFB108 from Chemetall GmbH, Frankfurt) in water. The hardening temperature following slow drying was 280° C.

The corrosion tendency test was carried out as described in Example 1.

The result of the final visual examination was 8 opening rollers showing rust efflorescence.

EXAMPLE 3

Surface treatment of opening rollers having a slot-fitted raw wire clothing with an aqueous monoaluminum phosphate solution followed by deburring and coating:

100 opening rollers as in Example 1 were subjected to the same treatment as described in Example 1. In contradistinction to Example 1, the impregnant used for the voids was a 20% strength solution of monoaluminum phosphate in water. The hardening temperature following slow drying was 300° C.

The corrosion tendency test was carried out as described in Example 1.

The final visual examination found that only 4 of the 100 opening rollers had rust spots.

Comparative Example 1

Process as per the prior art with separate deburring and coating:

100 commercial opening rollers in a form corresponding to FIG. 1 were coated with a nickel-diamond dispersion coat as specified as standard for such components by the leading manufacturers of open end spinning machines. The clothing wire mounted on these rings already had the necessary tooth tip geometry and surface quality ("needle finish"). The coating process comprised the steps of degreasing, pickle descaling, pickle activation of the steel wire, activation of the aluminum body and nickelization with simultaneous embedding of diamond particles.

The coating was followed by the usual heat treatment of 2 hours at 350° C. for obtaining the maximum wear resistance for such coats. Finally the coated and heat treated parts were freed of adherent diamond particles and other impurities by blasting with fine glass balls.

The corrosion tendency test was carried out as described in Example 1.

In the final examination, only 6 of the 100 opening rollers were found to exhibit rust efflorescence in a plurality of areas.

Comparative Example 2

Deburring and coating of opening rollers having a slot-fitted raw wire clothing without pretreatment according to the invention:

100 opening rollers as in Example 1 were deburred in a single multi-stage treatment process and provided with a nickel-diamond coating, both operations being carried out in a conventional manner and as described in Example 1.

The ready-coated parts were heat treated and cleaned by glass ball blasting, both operations being carried out as described in Example 1.

The corrosion tendency test was carried out as described in Example 1.

The final examination showed that 58 of the 100 opening rollers exhibited rust efflorescence, in some cases to a severe degree. This proportion of parts prone to rusting is absolutely unacceptable to spinning mills because of the soiling and discoloration of the yarn product.

What is claimed is:

1. A surface treatment process for minimizing corrosion due to voids existing between the basic metallic-body of an opening roller for open end spinning and a raw wire clothing mounted thereon comprising prior to deburring and application of an antiwear coating, the steps of:

a) introducing the opening roller into a bath comprising a sealing material in such a way that said sealing material is deposited in and on the walls of the voids existing between the raw wire and the basic body of the roller; said sealing material being selected from the group consisting of silicates, phosphates mixtures thereof;

b) rinsing the sealing material from an outer surface of the opening roller to form a rinsed opening roller;

c) heat treating the rinsed opening roller to produce a pretreated opening roller at temperatures sufficient to (i) evaporate any solvent from the sealing material and to (ii) harden the sealing material so as to prevent attack on such material during deburring and coating, and then deburring and applying an antiwear coating to the pretreated opening roller.

2. The process of claim 1, wherein the sealing bath comprises a sealing material which on drying forms an unbroken insoluble film.

3. The process of claim 2, wherein the sealing bath comprises an aqueous solution.

4. The process of claim 1 wherein step a) is carried out under superatmospheric pressure in a closed dip vessel.

5. A process according to claim 1, further comprising the step of removing residual moisture from gaps between said basic body and said raw wire clothing after rinsing and before heat treating the opening roller.

6. The process of claim 6, wherein said step of removing the residual moisture includes the step of passing said opening roller through an oven maintained at a temperature to remove the residual moisture.

7. The process of claim 1, wherein the opening roller is heated and the heated roller is introduced into the sealing bath.

8. The process of claim 1, wherein said step of rinsing the sealing material from the outer surface of the opening roller includes a step of dipping said opening roller into at least one tank filled with water at room temperature.

9. The process of claim 1, further including the step of cooling said pretreated opening roller after heat treating and before deburring and anti-wear coating the pretreated opening roller.

10. The process of claim 1, wherein the opening roller comprises an aluminum or steel body and steel wire clothing and wherein prior to deburring, said rollers is subjected to a hot degreasing followed by an acidic pickle to remove an oxide film from steel surfaces thereof, and wherein after deburring, said rollers is subjected to a further pickle to activate the steel surfaces thereof, followed by treating said opening roller to activate aluminum surfaces thereof for chemical nickelization.

11. The process of claim 1, wherein said deburring includes subjecting said pretreated opening roller to a chemical deburring bath to remove sharp edges of teeth of the raw wire clothing.

* * * * *